US008254802B2

(12) United States Patent
Hanashi et al.

(10) Patent No.: US 8,254,802 B2
(45) Date of Patent: Aug. 28, 2012

(54) IMAGE HEATING APPARATUS

(75) Inventors: Ryo Hanashi, Moriya (JP); Kota Arimoto, Abiko (JP); Taisuke Matsuura, Toride (JP); Jun Tomine, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 962 days.

(21) Appl. No.: 11/470,410

(22) Filed: Sep. 6, 2006

(65) Prior Publication Data

US 2007/0059021 A1 Mar. 15, 2007

(30) Foreign Application Priority Data

Sep. 13, 2005 (JP) ..... 2005-265872

(51) Int. Cl.
*G03G 21/20* (2006.01)

(52) U.S. Cl. ..... 399/92; 399/33; 399/94; 165/59; 165/98

(58) Field of Classification Search ..... 399/92, 399/33, 94
See application file for complete search history.

(56) References Cited

U.S. PATENT DOCUMENTS

| | | | | |
|---|---|---|---|---|
| 5,148,226 | A | 9/1992 | Setoriyama et al. | 355/290 |
| 5,210,579 | A | 5/1993 | Setoriyama et al. | 355/285 |
| 5,307,132 | A * | 4/1994 | Tsuchiya | 399/70 |
| 5,453,824 | A * | 9/1995 | Vegeais | 399/69 |
| 5,525,775 | A | 6/1996 | Setoriyama et al. | 219/216 |
| 5,550,621 | A * | 8/1996 | Ogawahara | 399/69 |
| 5,742,865 | A | 4/1998 | Yajima et al. | 399/43 |
| 5,787,321 | A | 7/1998 | Nishikawa et al. | 399/69 |
| 6,324,361 | B1 * | 11/2001 | Itoh et al. | 399/92 |
| 6,754,458 | B2 | 6/2004 | Makihira | 399/92 |
| 7,098,430 | B2 | 8/2006 | Kondo et al. | 219/619 |
| 7,122,769 | B2 | 10/2006 | Nami et al. | 219/619 |
| 7,421,219 | B2 * | 9/2008 | Matsuura et al. | 399/45 |
| 7,433,625 | B2 * | 10/2008 | Yamaoka et al. | 399/92 |
| 7,536,145 | B2 * | 5/2009 | Tomine et al. | 399/328 |
| 7,542,692 | B2 * | 6/2009 | Yamamoto et al. | 399/69 |

(Continued)

FOREIGN PATENT DOCUMENTS

JP 60-136779 7/1985

(Continued)

OTHER PUBLICATIONS

Translation of Abstract JP 04051179A.*

(Continued)

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

An image heating apparatus including: an image heating member for heating an image formed on a sheet at a nip portion; a temperature detector for detecting temperature of a predetermined region of the image heating member; a cooler for cooling the predetermined region; and an activating device for activating the cooler to perform a cooling operation in accordance with an output of the temperature detector, wherein the apparatus has a first mode of stopping a cooling operation in accordance with an output of the temperature detector; and a second mode of stopping the cooling operation in accordance with an end of image heating processing irrespective of the output of the temperature detecting device. The image heating apparatus is capable of suppressing unnecessary energy consumption, and of eliminating uneven glossiness due to a reduced temperature region at a boundary between a sheet passing portion and a non-sheet passing portion.

5 Claims, 15 Drawing Sheets

U.S. PATENT DOCUMENTS

| | | | | |
|---|---|---|---|---|
| 7,561,818 | B2 * | 7/2009 | Arimoto et al. | 399/92 |
| 7,609,991 | B2 * | 10/2009 | Koshida | 399/92 |
| 7,684,724 | B2 * | 3/2010 | Arimoto et al. | 399/92 |
| 7,764,895 | B2 * | 7/2010 | Tomine et al. | 399/69 |
| 7,890,014 | B2 * | 2/2011 | Koshida | 399/92 |
| 7,949,280 | B2 * | 5/2011 | Arimoto et al. | 399/92 |
| 8,068,758 | B2 * | 11/2011 | Kaji | 399/69 |
| 8,116,654 | B2 * | 2/2012 | Suzuki | 399/92 |
| 2005/0111864 | A1 * | 5/2005 | Yamaguchi | 399/69 |
| 2005/0180787 | A1 | 8/2005 | Nami et al. | 399/328 |
| 2007/0059010 | A1 | 3/2007 | Arimoto et al. | 399/69 |
| 2007/0059012 | A1 | 3/2007 | Tomine et al. | 399/69 |

FOREIGN PATENT DOCUMENTS

| | | | |
|---|---|---|---|
| JP | 4-44075 | | 2/1992 |
| JP | 4-44076 | | 2/1992 |
| JP | 4-44077 | | 2/1992 |
| JP | 4-44078 | | 2/1992 |
| JP | 4-44079 | | 2/1992 |
| JP | 4-44080 | | 2/1992 |
| JP | 4-44081 | | 2/1992 |
| JP | 4-44082 | | 2/1992 |
| JP | 4-44083 | | 2/1992 |
| JP | 04051179 | A * | 2/1992 |
| JP | 4-204980 | | 7/1992 |
| JP | 4-204981 | | 7/1992 |
| JP | 4-204982 | | 7/1992 |
| JP | 4-204983 | | 7/1992 |
| JP | 4-204984 | | 7/1992 |
| JP | 5-119669 | | 5/1993 |
| JP | 7-064422 | | 3/1995 |
| JP | 9-244465 | | 9/1997 |
| JP | 2004-171013 | | 6/2004 |

OTHER PUBLICATIONS

Translation of Abstract JP 04051179A, Feb. 1992.*

Notification of Reason for Refusal in Japanese Patent Application No. 2005-265872, dated Sep. 21, 2010 (with English translation).

Japanese Office Action mailed May 17, 2011, in counterpart Japanese Application No. 2005-265872, and English-language translation thereof.

* cited by examiner

IMAGE HEATING APPARATUS

BACKGROUND OF THE INVENTION

1. Field of the Invention

The present invention relates to an image heating apparatus, which heats an image formed on a recording material. By providing the image heating apparatus, it is possible to obtain a fixing apparatus for fixing an unfixed image on a recording material, and a gloss improving apparatus for improving gloss of an image by re-heating an image fixed on a recording material. The image heating apparatus is used in an image forming apparatus such as a copying machine, a printer, a facsimile, and a composite machine having a plurality of functions thereof.

2. Related Background Art

Up to now, in such the image forming apparatus, as a fixing method of fixing an unfixed toner image on a recording material, a thermal fixing method in which an unfixed toner image is heated and fused to be fixed on the recording material is generally used in view of safety and excellent fixing property.

In particular, in view of excellent thermal efficiency, easiness of down-sizing, and the like, widely used is a heat roller method in which an unfixed toner image formed on a recording material is heated and pressurized to be thermally-fixed on a fixing area in which a heat roller and a pressure roller are in pressure contact with each other.

A heat-roller-type fixing apparatus uses a fixing roller provided with a heater therein and a pressure roller which is opposed to and brought into pressure contact with the fixing roller, thereby introducing a recording material into a fixing nip portion located between the pair of rollers, to be passed through the pair of rollers. Thus, an unfixed toner image formed and carried on a surface of the recording material is fixed by heat and pressure.

In recent years, a film-heating-type fixing apparatus is put into practical use from the viewpoint of quick-start ability and energy-saving ability.

In the film-heating-type fixing apparatus, a heat-resistant film (hereinafter, referred to as "fixing film") is sandwiched between a ceramic heater serving as a heating member and a pressure roller serving as a pressure member, thereby forming a fixing nip portion. Then, a recording material on which an unfixed toner image is formed and carried is introduced between the fixing film and the pressure roller of the fixing nip portion, thereby being nipped and transported together with the fixing film. As a result, the unfixed toner image is fixed on the surface of the recording material by contact pressure of the fixing nip portion while being supplied with heat of the ceramic heater through the fixing film.

In the film-heating-type fixing apparatus, it is possible to constitute an on-demand-type apparatus by using a member having a lower heat capacity for the ceramic heater and the film, and it is sufficient that the ceramic heater serving as a heat source is energized only at the time of executing image formation to heat the ceramic heater up to a predetermined fixing temperature. Therefore, the film-heating-type fixing apparatus has advantages in that a waiting time between power-on of an image forming apparatus and a time point of being in a state where image formation is ready to be executed is short (i.e., quick-start ability), power consumption in a standby state is significantly reduced (i.e., power-saving), and the like.

In such the film-heating-type fixing apparatus, a conventional feed-back type power control is performed. In this control, based on temperature detected by, for example, a temperature detecting means which is provided by being bonded or the like to a back surface of the ceramic heater, electric energy applied to the heater is controlled by a method such as a proportional control to thereby keep the heater at constant temperature.

In the heat-roller-type or film-heating-type fixing apparatus described above, there is a problem of temperature rise of a non-sheet passing portion at a time of continuous supply of recording materials having a narrower width (hereinafter, referred to as "small-size sheet") than a recording material having a maximum sheet passing width (hereinafter, referred to as "maximum-size sheet").

Recording materials having a variety of sizes (i.e., widths) pass a fixing area. The fixing area through which the recording materials pass is called a sheet passing area, and a fixing area other than the sheet passing area is called a non-sheet passing area. In addition, a surface portion of the heat roller which passes the sheet passing area at a time of rotation is called a sheet passing area passing surface, and a surface portion of the heat roller which passes the non-sheet passing area at a time of rotation is called a non-sheet passing area passing surface.

When the maximum-size sheet is passed to have an image fixation thereto, it is possible to obtain a temperature distribution in which temperature of the surface of the heat roller is substantially the same over the whole length of the fixing area. However, when the small-size sheets are continuously supplied to have an image fixation thereto, temperature of the non-sheet passing area passing surface of the heat roller is excessively raised. This is because, when the small-size sheets are continuously supplied, heat is not drawn by a sheet in the non-sheet passing area through which a sheet does not pass, so heat is accumulated in the non-sheet passing area.

Accordingly, a fixing device described in JP S60-136779 A has a structure in which the non-sheet passing portion described above is cooled by a cooling fan.

To be specific, in the fixing device described in JP S60-136779 A, a temperature sensor, which detects the temperature of the non-sheet passing portion is provided, and the cooling fan is turned on when the temperature detected by the temperature sensor becomes 210° C. or higher. Then, the cooling fan is turned off when the temperature detected by the temperature sensor becomes lower than 210° C.

However, in the fixing device described in JP 60-136779 A, there is a fear that the following problem may be caused.

In other words, because the fixing device has the structure in which the cooling fan is turned on while the temperature detected by the temperature sensor is 210° C. or higher, the cooling fan is maintained to be turned on even when an image forming job is completed.

Accordingly, even when energization to the heater is stopped in accordance with the end of the job to naturally cool the non-sheet passing portion, the cooling fan is continuously operated after the job is completed, which leads to unnecessary energy consumption.

Further, it is preferable that the film be rotationally driven during the operation of the cooling fan to prevent uneven cooling, so there is a fear that a life span of the film is shortened due to the continuous operation of the cooling fan after the job is completed.

SUMMARY OF THE INVENTION

An object of the present invention is to provide an image heating apparatus capable of performing a cooling operation of an image heating member with efficiency.

It is an object of the present invention to provide an image heating apparatus including: an image heating member, which heats an image formed on a recording material at a nip portion; temperature detecting means for detecting temperature of a predetermined region of the image heating member; cooling means for cooling the predetermined region of the image heating member; and activating means for activating the cooling means to perform a cooling operation in accordance with an output of the temperature detecting means, wherein the image heating apparatus has: a first mode of stopping the cooling operation in accordance with an output of the temperature detecting means; and a second mode of stopping the cooling operation in accordance with an end of image heating processing irrespective of the output of the temperature detecting means.

It is still another object of the present invention to provide an image heating apparatus including: an image heating member, which heats an image formed on a recording material at a nip portion; temperature detecting means for detecting temperature of a predetermined region of the image heating member; cooling means for cooling the predetermined region of the image heating member; and control means for controlling a cooling operation of the cooling means, wherein the control means activates the cooling means to perform the cooling operation in accordance with an output of the temperature detecting means and stopping the cooling operation in accordance with an end of image heating processing.

Further features of the present invention will become apparent from the following description of exemplary embodiments with reference to the attached drawings.

DESCRIPTION OF THE EMBODIMENTS

Hereinafter, the present invention will be described in detail by referring to embodiments. It should be noted that the embodiments are examples of best embodiment modes of the present invention. However, the present invention is not limited to a variety of constitutions described in the embodiments. In other words, the variety of constitutions described in the embodiments can be replaced with another well-known constitution within a scope of an idea of the present invention.

First Embodiment (1) Image Forming Portion

Figure 2:
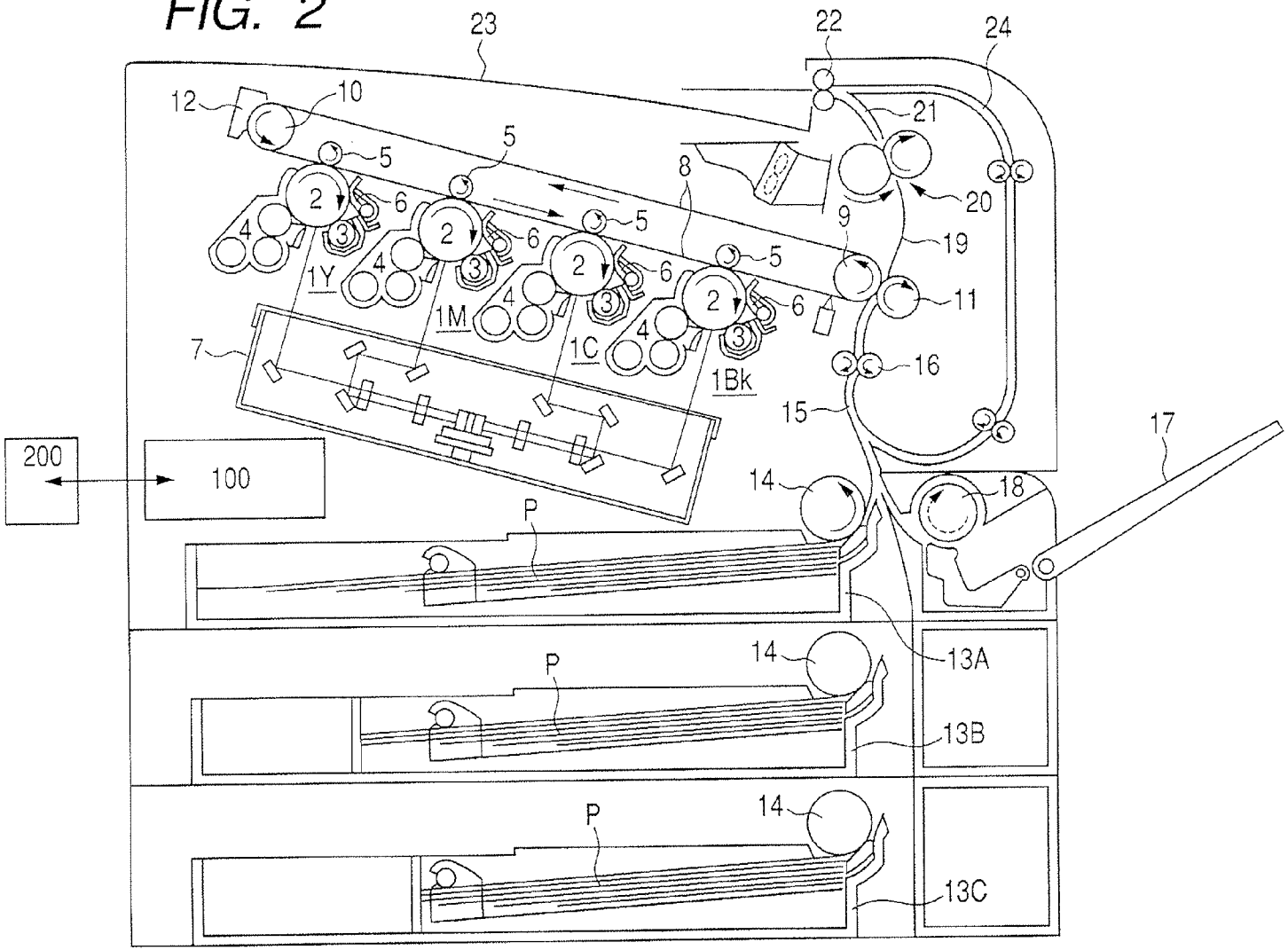
FIG. 2 is a longitudinal sectional view schematically showing an example of an image forming apparatus mounted with the fixing apparatus.

FIG. 2 is a schematic longitudinal sectional view showing an electrophotographic full-color printer which is an example of an image forming apparatus mounted with an image heating apparatus according to the present invention as a fixing apparatus. First, an outline of an image forming portion will be described.

This printer performs an image forming operation in accordance with input image information from an external host device 200 connected to a control circuit portion (i.e., control substrate; CPU) 100 so as to communicate with each other, thereby making it possible to form a full-color image on a recording material and output the formed full-color image.

The external host device 200 is a computer, an image reader, or the like. The control circuit portion 100 transmits/receives a signal to/from the external host device 200. In addition, the control circuit portion 100 transmits/receives a signal to/from a variety of image forming devices and controls an image formation sequence.

An intermediate transfer belt (hereinafter, briefly referred to as "belt") 8, which is an endless flexible belt, is stretched around a secondary transferring opposing roller 9 and a tension roller 10. The intermediate transfer belt 8 is rotationally driven counterclockwise as indicated by the arrows at a predetermined speed by a drive of the secondary transferring opposing roller 9. A secondary transfer roller 11 is brought into pressure contact with the secondary transferring opposing roller 9 through the belt 8. An abutting portion between the belt 8 and the secondary transferring roller 11 is a secondary transferring portion.

A first image forming portion 1Y, a second image forming portion 1M, a third image forming portion 1C, and a fourth image forming portion 1Bk are arranged in a line on a lower side of the belt 8 at predetermined intervals along a belt movement direction. The image forming portions each has an electrophotographic process mechanism of a laser exposure system, and have a drum-type electrophotographic photosensitive member (hereinafter, briefly referred to as "drum") 2 serving as an image bearing member which is rotationally driven clockwise as indicated by the arrow at a predetermined speed. On the periphery of each drum 2, a primary charger 3, a developing device 4, a transferring roller 5 serving as a transferring means, and a drum cleaning device 6 are arranged. Each transferring roller 5 is arranged inside the belt 8, and is brought into pressure contact with the corresponding drum 2 through the belt 8. An abutting portion between each drum 2 and the belt 8 is a primary transferring portion. A laser exposure device 7 opposing the drum 2 of each of the image forming portions is constituted of laser emitting means for emitting light corresponding to a time-series electric digital image signal of given image information, a polygon mirror, a reflecting mirror, and the like.

The control circuit portion 100 causes each of the image forming portions to perform an image formation operation based on a color separation image signal inputted from the external host device 200. As a result, in the first to fourth image forming portions 1Y, 1M, 1C, and 1Bk, color toner images for Yellow, Magenta, Cyan, and Black are formed on the respective surfaces of the rotating drums 2 at a predetermined timing. It should be noted that the principle and process of the electrophotographic image formation in which toner images are formed on the drums 2 are well-known, so the description thereof will be omitted.

The toner images formed on the respective surfaces of the drums 2 of the image forming portions are sequentially transferred and superposed onto an outer surface of the belt 8 which is rotationally driven in a forward direction with respect to a rotation direction of each drum 2 at a speed corresponding to the rotation speed of each drum 2. As a result, four toner images formed on the surface of the belt 8 are superposed on top of one another to be composited to form an unfixed full-color toner image.

On the other hand, at a predetermined sheet feeding timing, a sheet feeding roller 14, which is provided on a feed cassette on a stage selected among vertical multi-stage cassette sheet feeding portions 13A, 13B, and 13C for stacking and containing recording materials P each having a variety of width sizes, is driven. As a result, the recording materials P staked and contained in the sheet feed cassette on the stage are separately fed one by one through a vertical transport path 15, and are transported to registration rollers 16. When a manual sheet feeding is selected, a sheet feed roller 18 is driven. Thus, one sheet of the recording materials set to be stacked on a manual feed tray (i.e., multi-purpose tray) 17 is separately fed through the vertical transport path 15 to be transported to the registration rollers 16.

The registration rollers 16 transport the recording material P at a predetermined timing so that a leading edge of the recording material P reaches the secondary transferring portion at a timing when a leading end of the full-color toner image formed on the rotating belt 8 reaches the secondary transferring portion. As a result, in the secondary transferring portion, the full-color toner images formed on the belt 8 are collectively and secondarily-transferred on a surface of the recording material P. The recording material P, after passing the secondary transferring portion, is separated from the surface of the belt 8, is guided into a vertical guide 19, and is introduced into a fixing apparatus (i.e., fixing device) 20. By the fixing apparatus 20, the multiple-color toner images are fused to be mixed, and are fixed on the surface of the recording material as a permanent fixed image. The recording material P, which has passed the fixing apparatus 20, is fed onto a delivery tray 23 as a full-color image product by delivery rollers 22 through a transport path 21.

In the secondary transferring portion, the surface of the belt 8 after being separated from the recording material is cleaned by removing residual extraneous matters such as secondary transfer residual toner by a belt cleaning device 12, so the surface of the belt 8 can be repeatedly used for image formation.

In a monochrome printing mode, only the fourth image forming portion Bk for forming a black toner image is controlled to perform an image formation operation. When a two-side printing mode is selected, a recording material, a first surface of which has been printed, is fed onto the delivery tray 23 by the delivery rollers 22. At a time point immediately before a trailing edge of the recording material passes the delivery rollers 22, the rotation of the delivery rollers 22 is converted into a reverse rotation. As a result, the recording material is switched back and is introduced into a re-transport path 24. Then, the front and the back surfaces of the recording material are turned over to be transported to the registration rollers 16 again. After that, in a similar manner as in the printing of the first surface, the recording material is transported to the secondary transferring portion and to the fixing apparatus 20, and is then fed onto the delivery tray 23 as a two-side printing image forming product.

(2) Fixing Apparatus 20

In the following description, a longitudinal direction with respect to a fixing apparatus or a member constituting the fixing apparatus indicates a direction parallel to a direction perpendicular to a recording material transport direction in a plane of a recording material transport path. As regards the fixing apparatus, a front thereof indicates a recording material introducing side, and left or right thereof indicates left or right when the apparatus is viewed from the front. A width of the recording material indicates a size of the recording material in a direction perpendicular to the recording material transport direction on the surface of the recording material.

Figure 1:
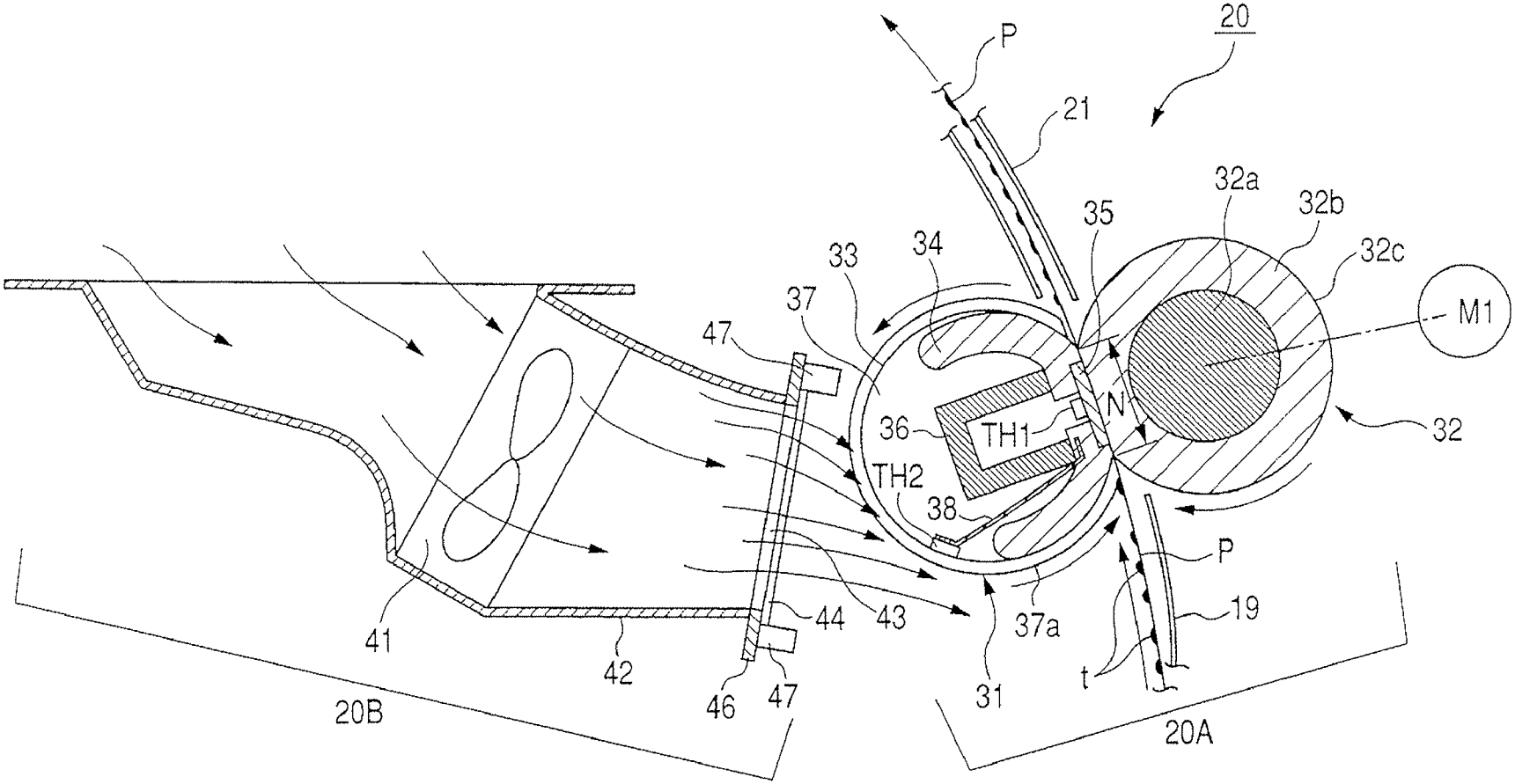
FIG. 1 is a cross-sectional view schematically showing a structure of a fixing apparatus (i.e., image heating apparatus) according to an embodiment.
Figure 3:
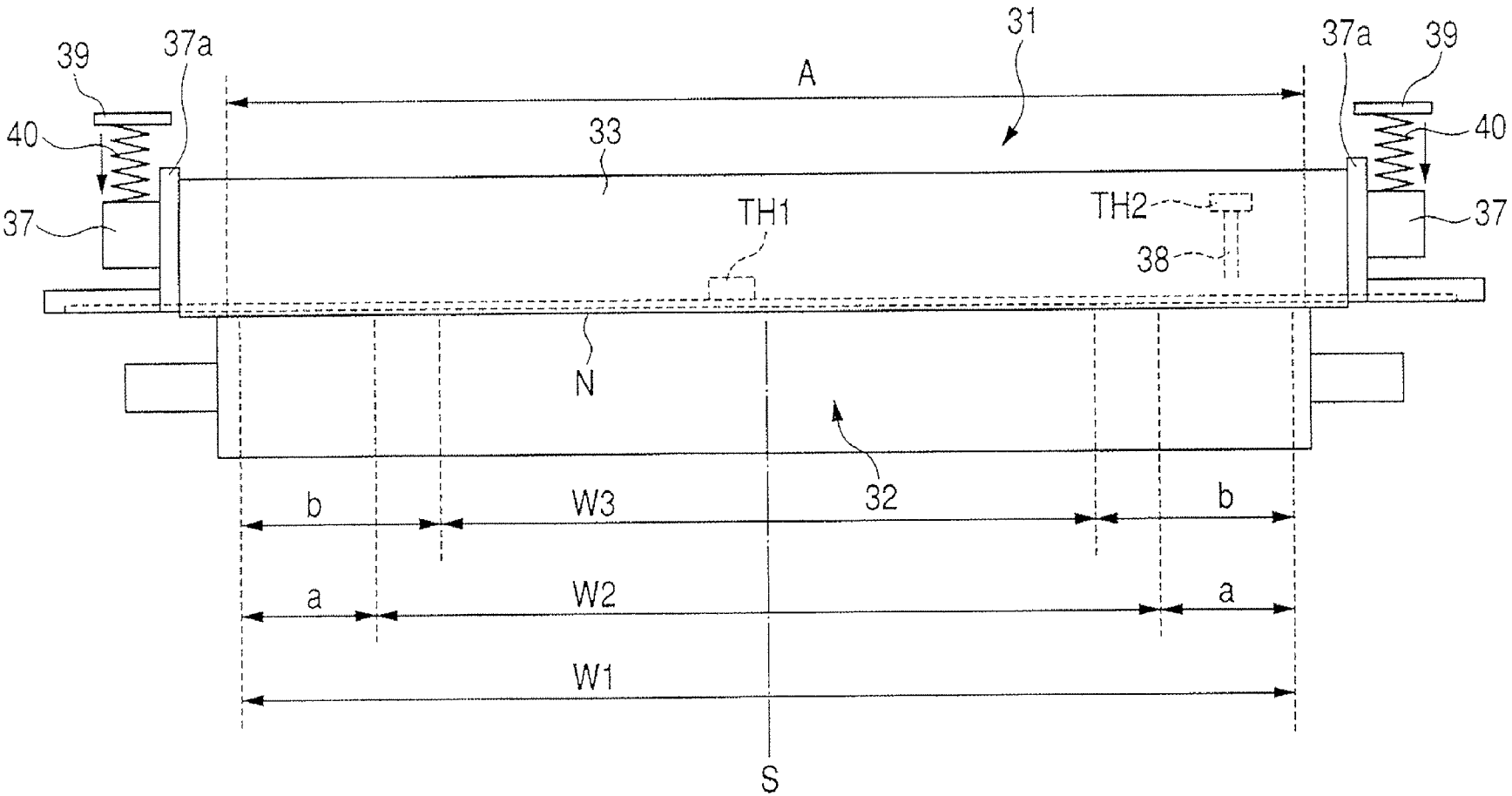
FIG. 3 is a schematic diagram showing a front of a fixing mechanism portion of the fixing apparatus.
Figure 4:
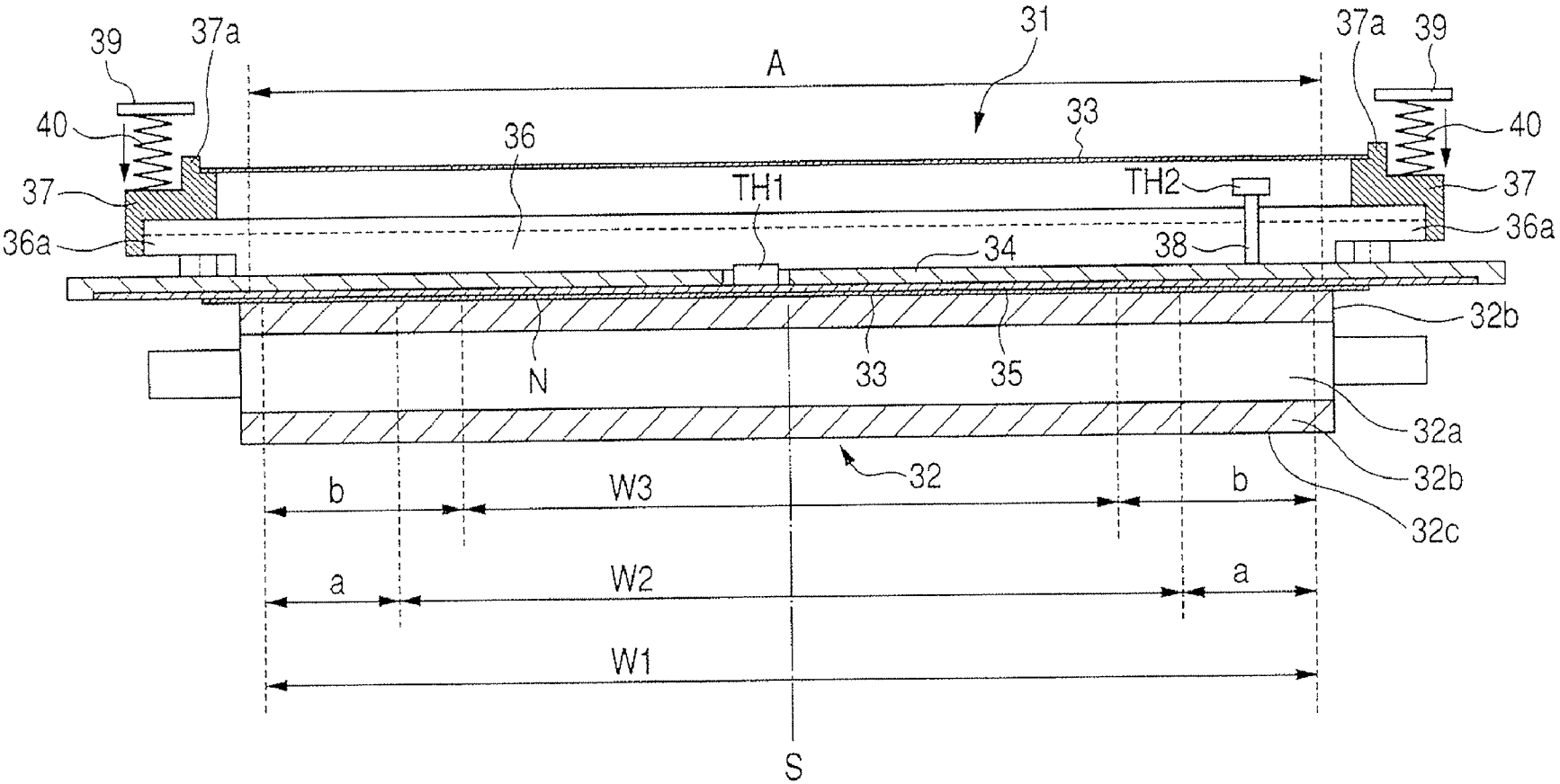
FIG. 4 is a longitudinal sectional view schematically showing the front of the fixing mechanism portion.

FIG. 1 is a schematic cross-sectional view showing the structure of the fixing apparatus 20 serving as an image heating apparatus. The fixing apparatus 20 is mainly composed of a film (i.e., belt) heating-type fixing mechanism portion 20A and an air blowing/cooling mechanism portion (i.e., cooling means) 20B. FIG. 3 is a schematic diagram of a front surface of the fixing mechanism portion 20A, and FIG. 4 is a schematic longitudinal sectional front view of the fixing mechanism portion 20A.

(2-1) Fixing Mechanism Portion 20A

First, an outline of the fixing mechanism portion 20A will be described. The fixing mechanism portion 20A is basically a film-heating-type and pressure-rotating-body-driving-type (i.e., tensionless-type) on-demand fixing apparatus, which is disclosed in JP H04-44075 A to JP H04-44083 A, JP H04-204980 A to JP H04-204984 A, and the like.

By contact pressures of a film assembly 31 and an elastic pressure roller (i.e., nip forming member) 32, a fixing nip (i.e., sheet passing nip) portion N is formed.

In the film assembly 31, a fixing film (which is also called a fixing belt; hereinafter, briefly referred to as "film") 33 has a cylindrical shape and flexibility and serves as an image heating member. A film guiding member (hereinafter, briefly referred to as "guide member") 34 with a trough shape and a semi-circular cross-sectional surface having heat resistance and rigidity. A ceramic heater (hereinafter, briefly referred to as "heater") 35 serving as a heat source is arranged on an outer surface of the guide member 34 so as to be fixingly fitted in a concave groove portion, which is provided along a longitudinal direction of the guide member 34. The film 33 is loosely externally fitted to the guide member 34 mounted with the heater 35. A pressure stay (hereinafter, briefly referred to as "stay") 36 having a U-shaped cross-sectional surface and rigidity is arranged inside the guide member 34. End portion holders 37 are fitted to each of outward projected arm portions 36*a* of left and right end portions of the stay 36. Flange portions 37*a* are integrated with the end portion holders 37.

The pressure roller 32 has a cored bar 32*a* provided with an elastic layer 32*b* made of silicon rubber or the like, thereby lowering the hardness thereof In order to improve a surface property, a fluororesin layer 32*c* made of PTFE, PFA, FEP, or the like may be provided. The pressure roller 32 serving as a pressure rotary member is arranged such that both end portions of the cored bar 32*a* are rotatably held by a bearing member between side plates provided at left and right of an apparatus chassis (not shown).

The heater 35 side of the film assembly 31 is arranged to be opposed to the pressure roller 32 to thereby be parallel to each other. A pressure spring 40 is shrunk between the left and right end portion holders 37 and left and right fixed spring receiving members 39. As a result, the stay 36, the guide member 34, and the heater 35 are pressed and urged against the pressure roller 32 side. The pressing/urging force is set at a predetermined level, and the heater 35 is brought into pressure contact with the pressure roller 32 against the elasticity of the elastic layer 32*b* through the film 33, thereby forming the fixing nip potion N having a predetermined width between the film 33 and the pressure roller 32 in the recording material transport direction.

Figure 5:
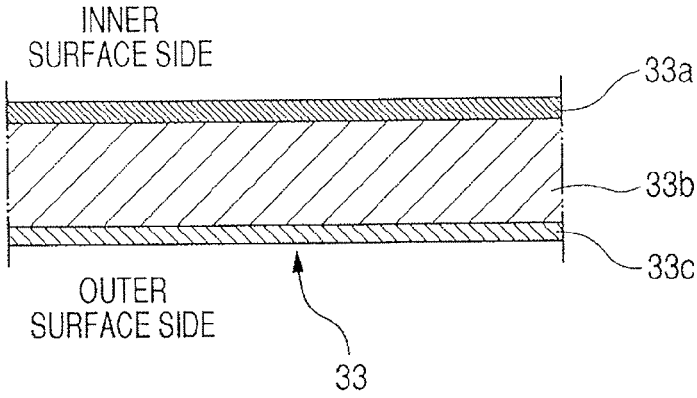
FIG. 5 is a schematic diagram showing a layer structure of a fixing film.

The film 33 according to this embodiment has, as shown in the schematic diagram of the layer structure of FIG. 5, a three-layer composite structure in which a base layer 33*a*, an elastic layer 33*b*, and a releasing layer 33*c* are provided in the order from an inner surface side to an outer surface side. For the base layer 33*a*, it is possible to use a heat-resistant film having a film thickness of 100 μm or thinner, preferably 50 μm or thinner and 20 μm or thicker, in order to reduce the heat capacity and improve the quick-start ability. For example, a film made of polyimide, polyimide-amide, PEEK, PES, PPS, PTFE, PFA, FEP, or the like may be used. In this embodiment, a cylindrical polyimide film having a diameter of 25 mm is used. For the elastic layer 33*b*, a silicone rubber having a rubber hardness of 10 degree (JIS-A), a heat conductivity of $4.18605\times10^{-1}$ W/m degree ($1\times10^{-3}$ [cal/cm. sec. deg.]), and a thickness of 200 μm is used. For the releasing layer 33*c*, a PFA coating layer having a thickness of 20 μm is used. Alternatively, a PFA tube may be used therefor. The PFA coating is excellent in that a thickness cannot be increased, and is more effective in coating toner as compared with the PFA tube in terms of a quality of a material. On the other hand, the PFA tube is more excellent than the PFA coating in terms of mechanical and electrical strengths, so both the PFA coating and the PFA tube can be used as the situation demands.

Figure 6:
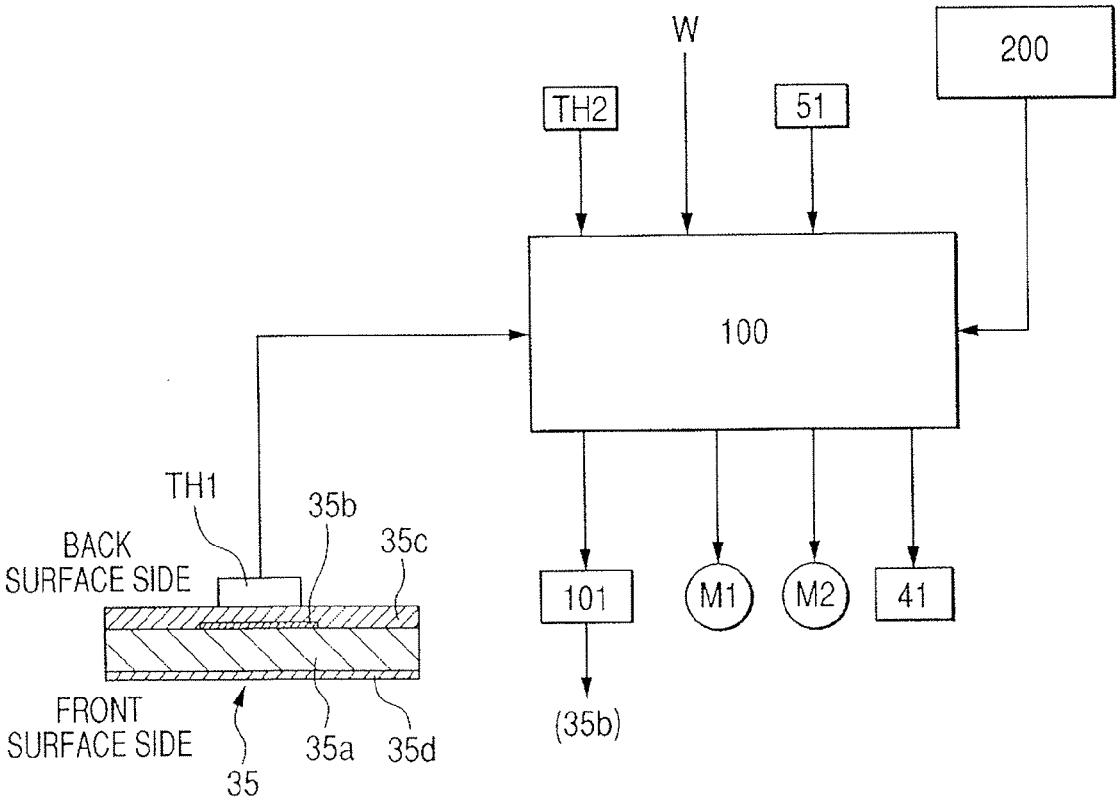
FIG. 6 is a cross-sectional view schematically showing a heater with a block diagram showing a control system.

The heater 35 according to this embodiment is of a back-surface-heating-type using aluminum nitride and the like as a heater substrate, and is a horizontally-long linear heating member having a low heat capacity with a longitudinal side in a direction perpendicular to the movement direction of the fixing film 33 and the recording material P. FIG. 6 is a schematic cross-sectional view of the heater 35 with a block diagram of a control system of the heater 35. The heater 35 includes a heater substrate 35*a* made of aluminum nitride and the like. The heater substrate 35*a* includes an energizing heating layer 35*b* on the back surface side thereof (opposite surface side with the fixing film opposing surface side) which is provided along the longitudinal direction thereof, and is coated with an electrical resistance material such as argentum/palladium (Ag/Pd), with a thickness of 10 μm and a width of 1 to 5 mm by screen printing or the like. Further, the heater 35 includes a protective layer 35*c* made of glass, a fluororesin, or the like on the energizing heating layer 35*b*. In this embodiment, on a front surface side of the heater substrate 35*a* (i.e., film opposing surface side), a sliding member (i.e., lubricating member) 35*d* is provided.

The heater 35 serving as a heating means is fixingly supported by exposing the heater substrate surface side thereof provided with the sliding member 35*d* to be fitted into a groove portion which is provided along the longitudinal side of the guide at the substantial center of the outer surface of the guide member 34. In the fixing nip portion N, the surface of the sliding member 35*d* of the heater 35 and the inner surface of the belt 33 slide to be in contact with each other. Then, the belt 33 serving as a rotary image heating member is heated by the heater 35.

The energizing heating layer 35*b* of the heater 35 is energized over longitudinal ends thereof, and the energizing heating layer 35*b* is heated to rapidly raise the temperature of the heater 35 in an entire area of an effective heat generation width A in the longitudinal direction of the heater. The temperature of the heater is detected by a first temperature sensor (i.e., first temperature detecting means; middle temperature sensor) TH1 such as a thermistor which is arranged by being brought into contact with the outer surface of the heater protective layer 35*c*. Then an output of the detected temperature (signal value of the temperature) is inputted to the control circuit portion 100 through an A/D converter. The control circuit portion 100 controls energization from a power supply (i.e., power supply part, or heater driving circuit portion) 101 to the energizing heating layer 35*b* based on the detected temperature information to be inputted so as to maintain the temperature of the heater at a predetermined level. In other words, the temperature of the belt 33 serving as the image heating member heated by the heater 35 is controlled at a predetermined fixing temperature in accordance with the output of the first temperature sensor TH1.

The pressure roller 32 is rotationally driven by a motor (i.e., drive means) M1 counterclockwise as indicated by the arrow. A torque acts on the belt 33 by a frictional force caused at the fixing nip portion N between the pressure roller 32 and the outer surface of the belt 33 due to the rotational driving of the pressure roller 32. As a result, the belt 33 is rotated around the guide member 34 in the counterclockwise direction indicated by the arrows while the inner surface thereof is sliding in close contact with the heater 35 (i.e., pressure roller driving method). The belt 33 is rotated at a circumferential speed substantially corresponding to a rotating circumferential speed of the pressure roller 32. Left and right flange portions 37*a* regulates an approaching movement by receiving the end portion of the belt at the approaching movement side when the rotating belt 33 is moved to approach leftward or rightward along the longitudinal side of the guide member 34. In order to reduce a mutual sliding frictional force generated in the fixing nip portion N between the heater 35 and the inner surface of the belt 33, the sliding member 35*d* is arranged on the surface of the heater in the fixing nip portion N, and a lubricant such as heat-resistant grease is mediated in the fixing nip portion N between the heater 35 and the inner surface of the belt 33.

Then, in response to a print start signal, the rotation of the pressure roller 32 is started, thereby starting heating-up of the heater 35. In a state where the rotating circumferential speed of the belt 33 is stabilized and the temperature of the heater 35 is raised at the predetermined temperature, the recording material P bearing a toner image "t" is introduced into the fixing nip potion N with the toner image bearing surface side as the belt 33 side. The recording material P is brought into close contact with the heater 35 through the belt 33 in the fixing nip portion N, thereby moving to pass the fixing nip portion N together with the belt 33. In the process of moving to pass the fixing nip portion N, the recording material P is provided with heat by the belt 33 heated by the heater 35, thereby heating and fixing the toner image "t" on the surface of the recording material P. The recording material P having passed the fixing nip portion N is separated from the belt 33 to be delivered and transported.

In this embodiment, transportation of the recording material P is performed by so-called central reference transportation in which the recording material is centered. In other words, with regard to any recording material with a variety of sizes in width which can pass the apparatus, a central portion of the recording material in the width direction thereof passes the central portion of the longitudinal direction of the fixing film 33. Reference symbol S denotes a recording material sheet passing reference line (i.e., virtual line).

Reference symbol W1 denotes a sheet passing width of the recording material having a maximum width (i.e., maximum sheet passing width) which can pass the apparatus. In this embodiment, the maximum sheet passing width W1 is an A3-size width of 297 mm (i.e., A3 longitudinal feed). The effective heat generation width A in the longitudinal direction of the heater is set to be slightly larger than the maximum sheet passing width W1. Reference symbol W3 denotes a sheet passing width of the recording material having a minimum width (i.e., minimum sheet passing width) which can pass the apparatus. In this embodiment, the minimum sheet passing width W3 is an A4-longitudinal-size width of 210 mm (i.e., A4 longitudinal feed). Reference symbol W2 denotes a sheet passing width of the recording material having a width between the width of the maximum width recording material and the width of the minimum width recording material. In this embodiment, the sheet passing width W2 is a B4-size width of 257 mm (i.e., B4 longitudinal feed). Hereinafter, the recording material having a width corresponding the maximum sheet passing width W1 is represented as a maximum size recording material, and the recording material having a width smaller than the recording material is denoted as a small-size recording material.

Reference symbol "a" denotes a differential width portion ((W1−W2)/2) between the maximum sheet passing width W1 and the sheet passing width W2, and reference symbol "b" denotes a differential width portion ((W1−W3)/2) between the maximum sheet passing width W1 and the minimum sheet passing width W3. In other words, each of the differential width portions "a" and "b" is a non-sheet passing portion generated when the B4 or A4R-size recording material, which is a small-size recording material, passes the apparatus. In this embodiment, the recording material sheet passing is performed by the central reference, so the non-sheet passing portions "a" and "b" are generated in left and right side portions of the sheet passing width W2 and in left and right side portions of the sheet passing width W3. The width of the non-sheet passing portion varies depending on the size of the width of the small-size recording material used for sheet passing.

The first temperature sensor (i.e., first temperature detecting means) TH1 is arranged to detect the temperature of the heater (i.e., temperature of the sheet passing portion) provided in the area corresponding to the minimum sheet passing width W3. A second temperature sensor TH2 (i.e., second temperature detecting means; end portion temperature sensor) such as a thermistor detects the temperature of the non-sheet passing portion. The output of the detected temperature (i.e., signal value of the temperature) is inputted to the control circuit portion 100 serving as a control means through an A/D converter.

In this embodiment, the temperature sensor TH2 is arranged to be elastically in contact with an inner surface of a base layer of a film portion which corresponds to the non-sheet passing portion "a". To be specific, the temperature sensor TH2 is arranged at a free end of an elastic supporting member 38 having a shape of a plate spring to which a base of the guide member 34 is fixed. By elastically abutting the temperature sensor TH2 against the inner surface of the base layer 33*a* of the film 33 by the elasticity of the elastic supporting member 38, thereby detecting the temperature of the film portion corresponding to the non-sheet passing portion "a".

It should be noted that the first temperature sensor TH1 may be arranged to be elastically brought into contact with the inner surface of the base layer of the film portion corresponding to the sheet passing width W3. Meanwhile, the second temperature sensor TH2 may be arranged to detect the temperature of the heater corresponding to the non-sheet passing portion "a".

(2-2) Air Blowing/Cooling Mechanism Portion 20B

Figure 7:
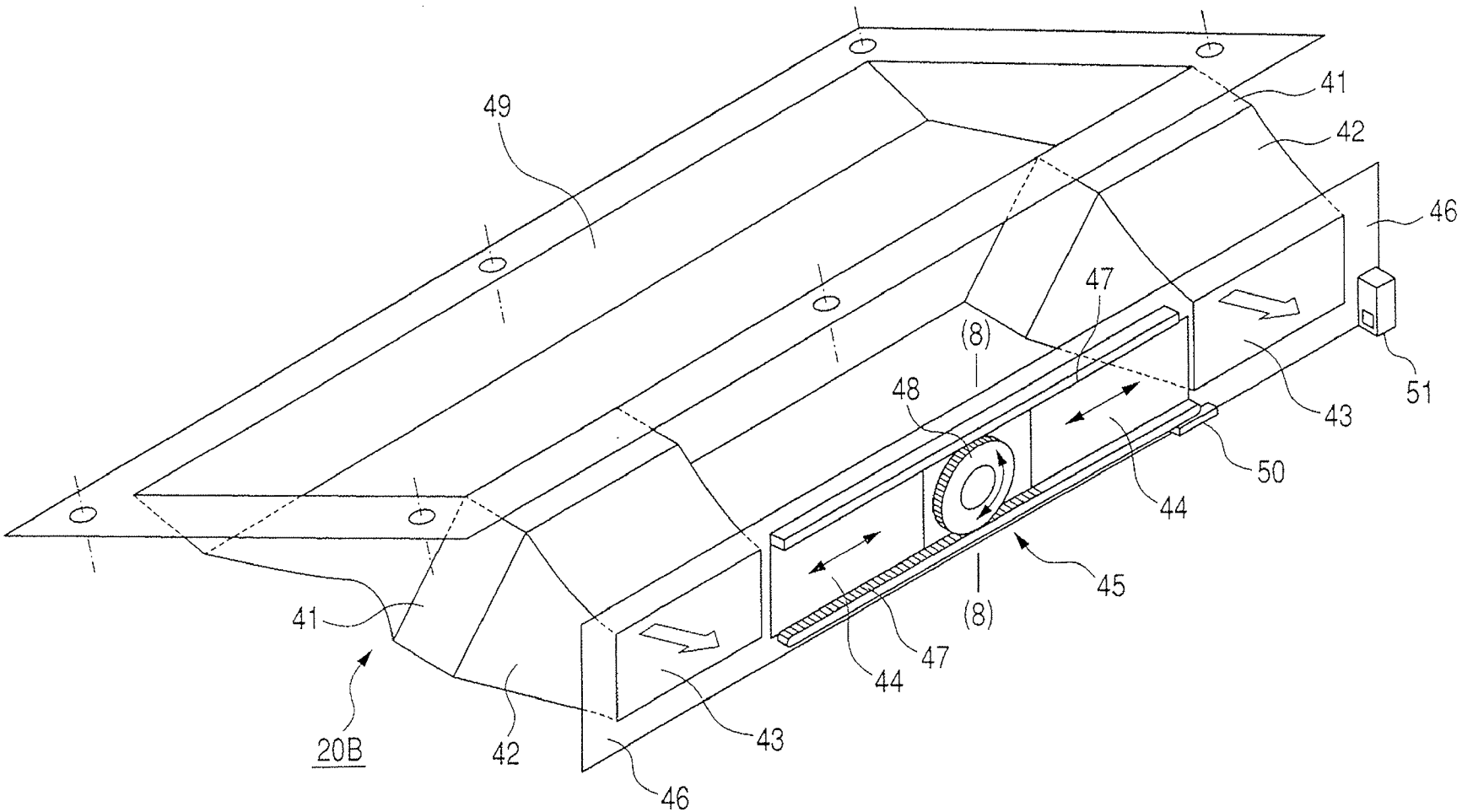
FIG. 7 is a perspective view schematically showing an external appearance of an air blowing/cooling mechanism portion.
Figure 8:
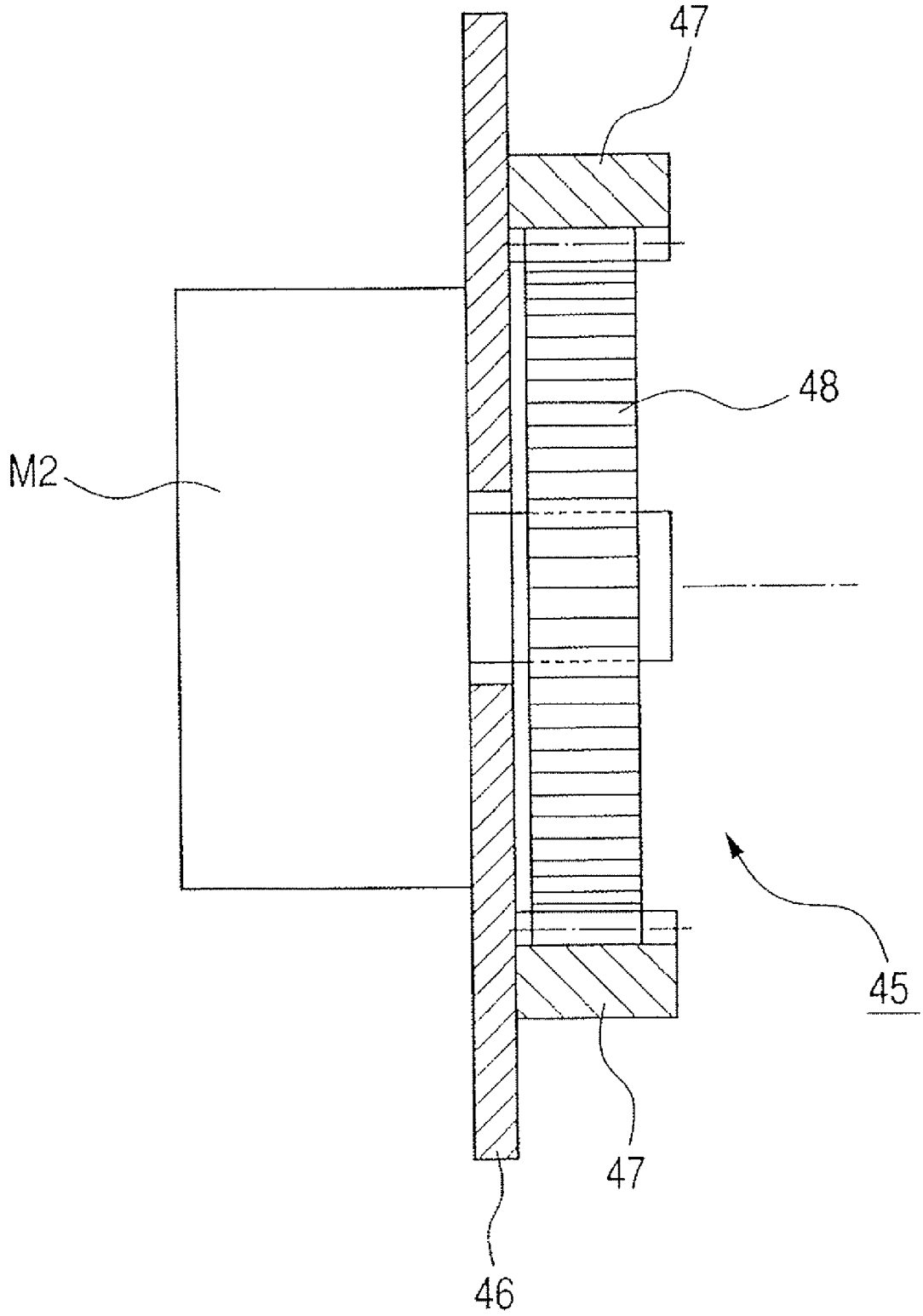
FIG. 8 is an enlarged sectional view taken along the line (8)-(8) shown in FIG. 7.

The air blowing/cooling mechanism portion 20B is cooling means for cooling by blowing air on the raised temperature of the non-sheet passing portion of the film 33, which is caused when continuous sheet passing (i.e., small size job) of small-size recording materials is performed. FIG. 7 is a schematic perspective view of an external appearance of the air blowing/cooling mechanism portion 20B. FIG. 8 is an enlarged view taken along a line (8)-(8) shown in FIG. 7.

Referring to FIGS. 1, 7, and 8, the air blowing/cooling mechanism portion 20B according to this embodiment will be described. The air blowing/cooling mechanism portion 20B includes cooling fans (hereinafter, briefly referred to as "fan") 41 serving as cooling means. Further, the air blowing/cooling mechanism portion 20B includes air blowing ducts 42 for guiding air generated by the fans 41, and air blowing ports (i.e., air duct opening portions) 43 which are arranged in a portion opposing the fixing mechanism portion 20A of the air blowing ducts 42. Still further, the air blowing/cooling mechanism portion 20B includes shutters (i.e., shielding plates) 44 for opening/closing the air blowing ports 43 and regulating an opening width as a width appropriate to the width of the recording material to be passed, and a shutter driving device (i.e., an opening width regulating means) 45 for driving the shutters 44.

The fans 41, the air blowing ducts 42, the air blowing ports 43, and the shutters 44 are arranged symmetrically with respect to the left and right portions of the film 33 in the longitudinal direction thereof. An intake channel portion 49 is arranged at an intake side of the fan 41. For the fan 41, a centrifugal fan such as a sirocco fan may be used.

The left and right shutters 44 are slidably supported in the horizontal direction along a plate surface of a supporting plate 46 extending in the horizontal direction thereof. The left and right shutters 44 are connected with each other by providing racks 47 and a pinion gear 48, and the pinion gear 48 is driven by a normal rotation or a reverse rotation by a motor (i.e., pulse motor) M2. As a result, the left and right shutters 44 are operated in association with each other, thereby being opened/closed in a symmetrical relation with respect to the air blowing ports 43 each corresponding thereto. The shutter driving device 45 is constituted of the supporting plate 46, the racks 47, the pinion gear 48, and the motor M2.

The left and right air blowing ports 43 are provided between a position which is a little close to the center from the non-sheet passing portion "b", which is generated when the minimum width recording material is passed, and the maximum sheet passing width W1. The left and right shutters 44 are arranged in a direction in which the air blowing ports 43 are closed outward from a longitudinal middle part of the supporting plate 46 by a predetermined amount.

Based on information such as an input of a size of a recording material to be used by a user, and a recording material width automatic detecting mechanism (not shown) of a sheet feeding cassette 13 or the manual feed tray 17, width information W (see FIG. 6) of a recording material to be passed is input to the control circuit portion 100 serving as control means. Then, the control circuit portion 100 controls the shutter driving device 45 based on the information. In other words, the pinion gear 48 is rotated by driving the motor M2, and the shutters 44 are moved by the racks 47, thereby making it possible to open the air blowing ports 43 by the predetermined amount.

Figure 9:
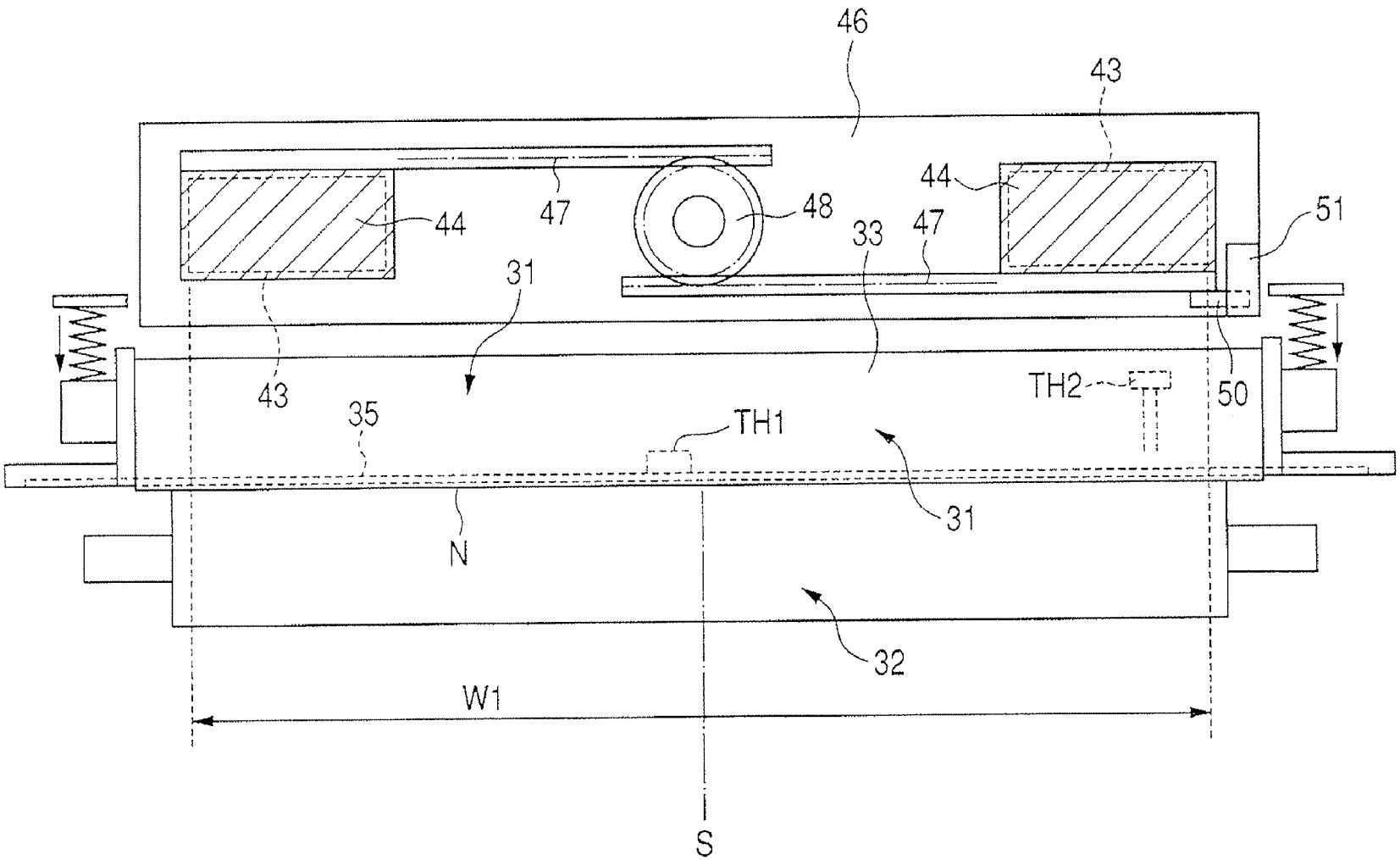
FIG. 9 is a constitutional diagram showing a state in which shutters are each moved to a fully-closed position in which air blowing ports are fully closed.
Figure 10:
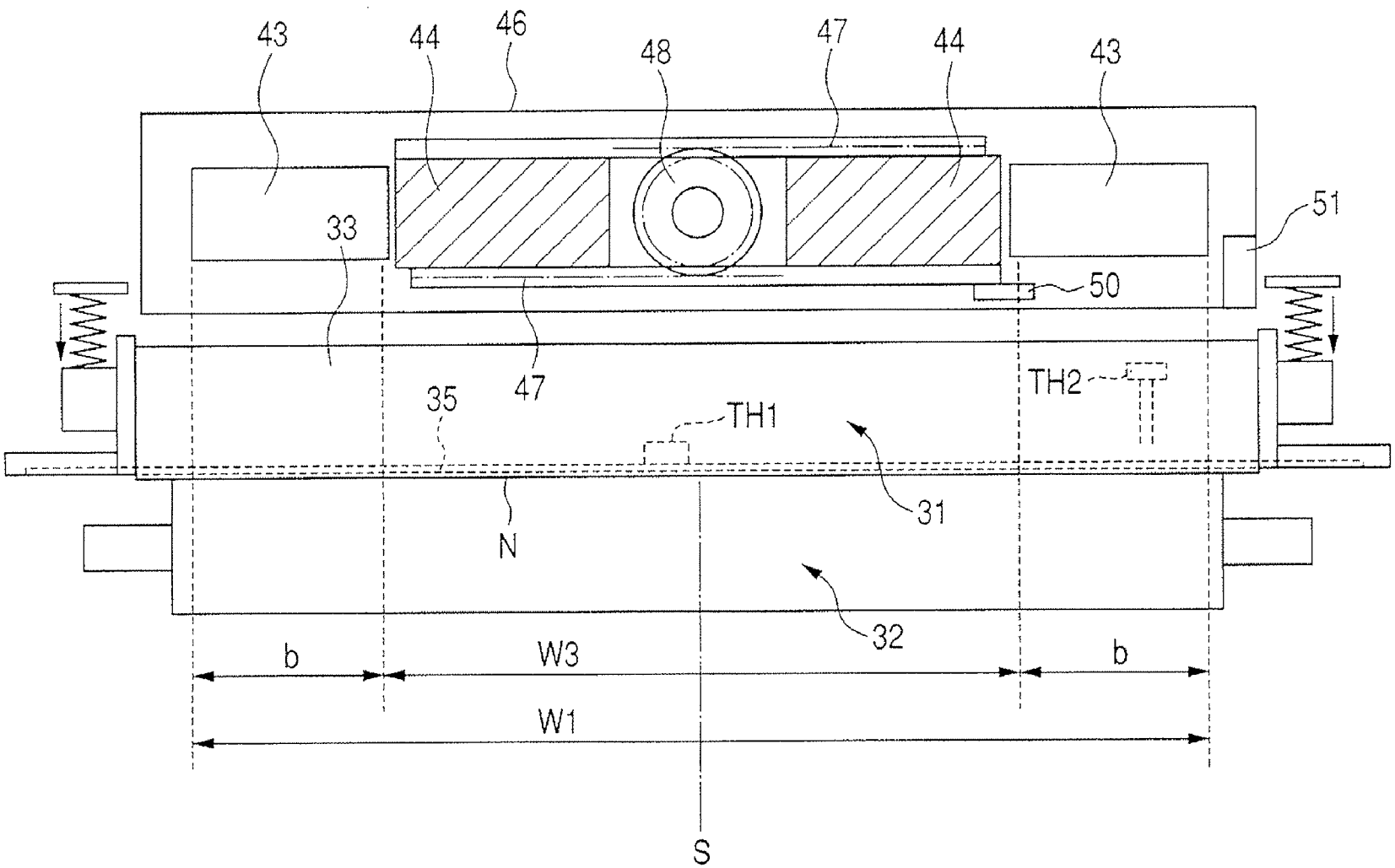
FIG. 10 is a constitutional diagram showing a state in which the shutters are each moved to a fully opened position in which the air blowing ports are fully opened.
Figure 11:
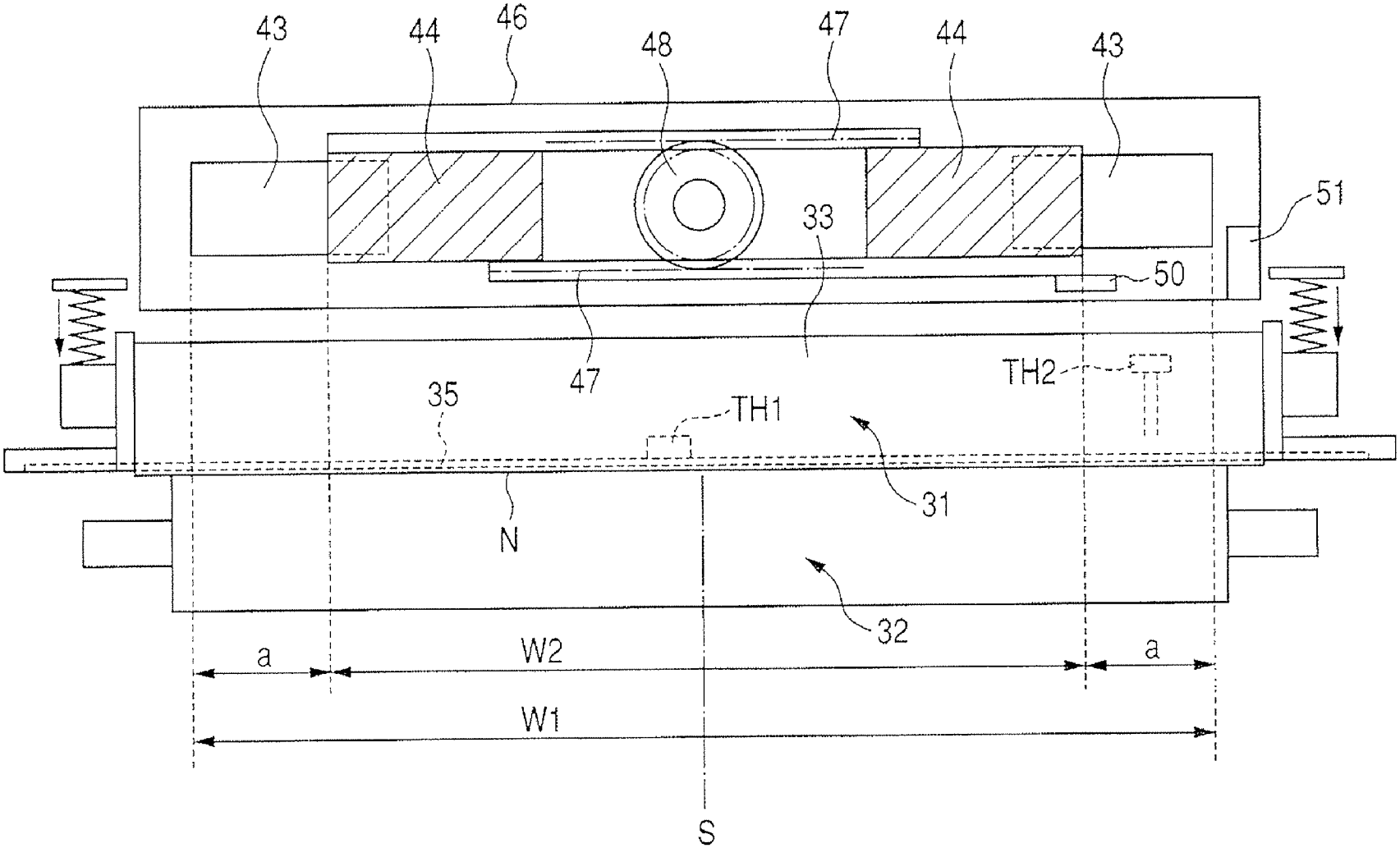
FIG. 11 is a constitutional diagram showing a state in which the shutters are each moved to a position in which only a portion of the air blowing port corresponding to a non-sheet passing portion "a" is opened.

The control circuit portion 100 controls the shutter driving device 45 to move the shutters 44 to a fully-closed position where the air blowing ports 43 are fully closed, as shown in FIG. 9, When the width information of the recording material indicates a large-size recording material of an A3-size width. On the other hand, the control circuit portion 100 controls the shutter driving device 45 to move the shutters 44 to a fully-opened position where the air blowing ports 43 are fully opened, as shown in FIG. 10, when the width information of the recording material indicates a small-size recording material of an A4-size width. When the width information of the recording material indicates a small-size recording material of a B4-size width, as shown in FIG. 11, the control circuit portion 100 controls the shutter driving device 45 to move the shutters 44 to a position where only a portion of the air blowing ports 43, which corresponds to the non-sheet passing portion "a", is opened. In other words, the control circuit portion 100 controls the opening width of the air blowing ports by controlling the positions of the shutters in accordance with the width size of the recording material.

It should be noted that, not shown in the drawings, in a case where the small-size recording material to be passed is LTR-R, EXE, K8, LTR, or the like, the control circuit portion 100 controls the shutter driving device 45 to move the shutters 44 to a position where the portion of the air blowing ports, which corresponds to the non-sheet passing portion, is opened.

That is, the shutters 44 can regulate the opening widths of the air blowing ports 43 in accordance with the width of the recording material.

Here, the sheet having the minimum, maximum, or various sheet sizes according to this embodiment means a recording material which is recommended (i.e., warranted) to be used in an image forming apparatus, so sheets having undefined sizes used by a user for a particular purpose are not assumed.

To detect positional information on the shutters 44, a sensor 51 arranged on the supporting plate 46 detects a flag 50 arranged at a predetermined position of the shutter 44. To be specific, as shown in FIG. 9, a home position is set at a shutter position where the air blowing ports 43 are fully closed, thereby detecting the opening amount by a rotational amount of the motor M2.

It is also possible that an opening width detecting sensor for directly detecting current positions of the shutters 44 is provided, and a sheet position information detected by the sensor is fed back to the control circuit, thereby controlling the shutters 44 to move to an appropriate opening width position by corresponding to the width of the recording material to be passed. A stop position of the shutter corresponding to the length in the width direction of the small-size recording material with high precision by detecting an edge position of the shutter by the sensor. Accordingly, it is possible to blow cooling air only for the non-sheet passing area of any small-size recording material.

(2-3) Operation Performed at a Temperature Rise of the Non-sheet Passing Portion With reference to FIGS. 11 and 12, a temperature rise of the non-sheet passing portion in a case (a small-size job) where small-size recording materials (herein, B4-size sheet) are continuously supplied will be described.

When the temperature of the heater 35 is controlled to be regulated based on the temperature detected by the first temperature sensor TH1 so as to provide a sufficient quantity of heat to a B4-size recording material which passes the sheet passing width W2, heat is not discharged in the non-sheet passing portion "a". As a result, each temperature of the portions corresponding to the non-sheet passing portion "a" of the heating member 31 and the pressure member 32 become higher compared with the temperature of the sheet passing area. A longitudinal temperature distribution of the fixing nip portion N of this case is indicated by a solid line L1 shown in FIG. 12. This is the temperature rise of the non-sheet passing portion.

As indicated by the solid line L1, an inter-sheet spacing of the continuous sheet passing of a recording material is increased, and the sheet passing portion is controlled to be set between a fixing upper-most temperature T2 and a fixing lower-most temperature T4 while the temperature rise of the non-sheet passing portion is maintained below a destructive temperature T1. At this time, an excellent image can be obtained, but, it is not desirable because productivity is remarkably deteriorated due to an increased inter-sheet spacing.

In this embodiment, the control circuit portion 100 drives the fans 41 of the air blowing/cooling mechanism portion 20B in accordance with the temperature (i.e., first control signal) detected by the second temperature sensor TH2. At a timing of driving the fans 41, a shutter control signal is sent to the shutter driving device 45 based on the paper size information W, thereby driving the motor M2 to move the shutters 44 to a position where the shutters 44 are regulated in the paper size W2. In other words, a portion of the air blowing port opposes the non-sheet passing portion "a", thereby blowing the cooling air generated by the fan 45 toward the non-sheet passing portion of the fixing mechanism portion 20A. The temperature of the non-sheet passing portion is lowered by blowing the cooling air against the non-sheet passing portion, thereby making it possible to obtain an excellent fixed image without lowering productivity due to an increased inter-sheet spacing.

Figure 12:
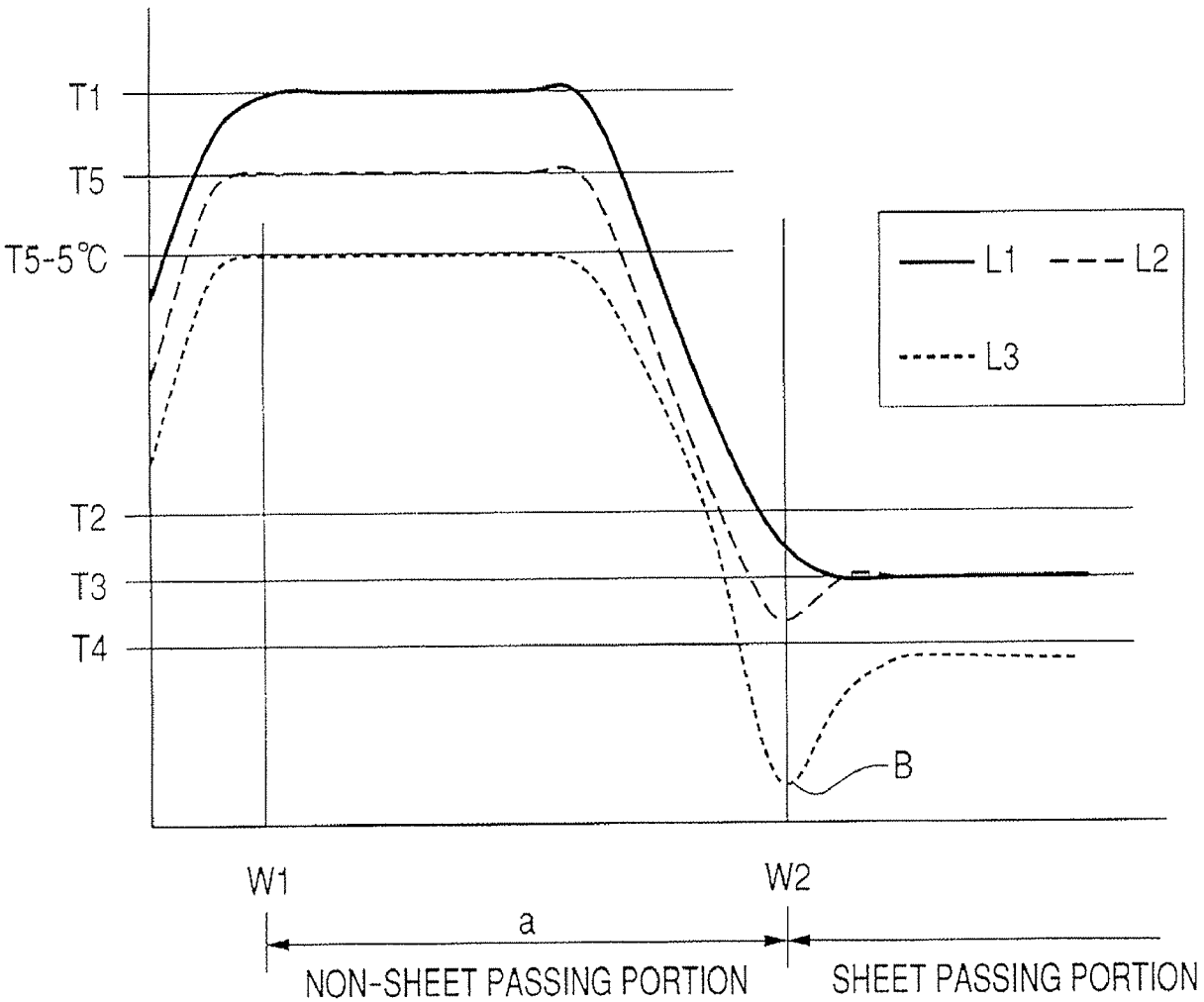
FIG. 12 is a diagram showing a longitudinal temperature distribution of a fixing nip.
Figure 13:
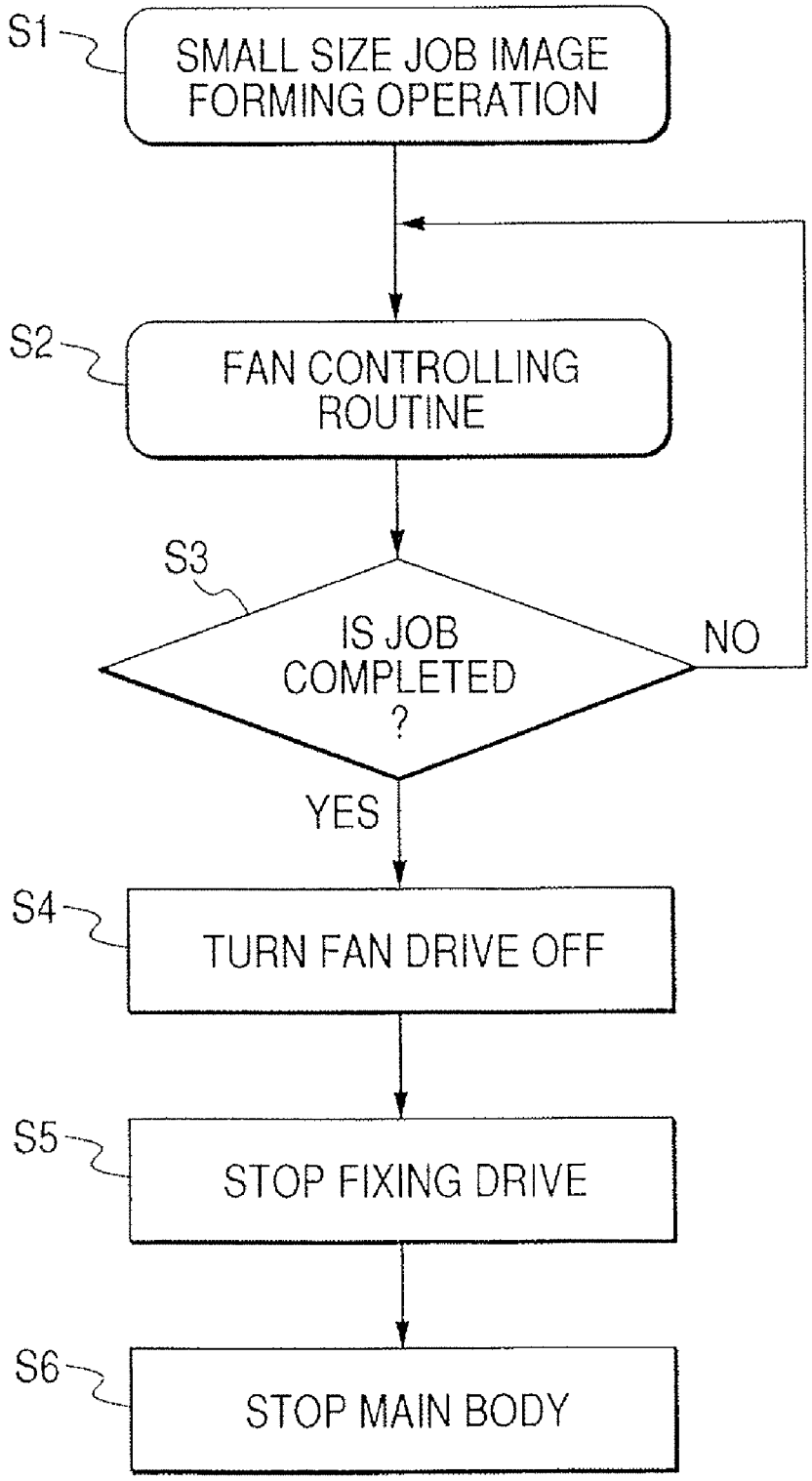
FIG. 13 is a flowchart showing a control timing of a cooling fan.
Figure 14:
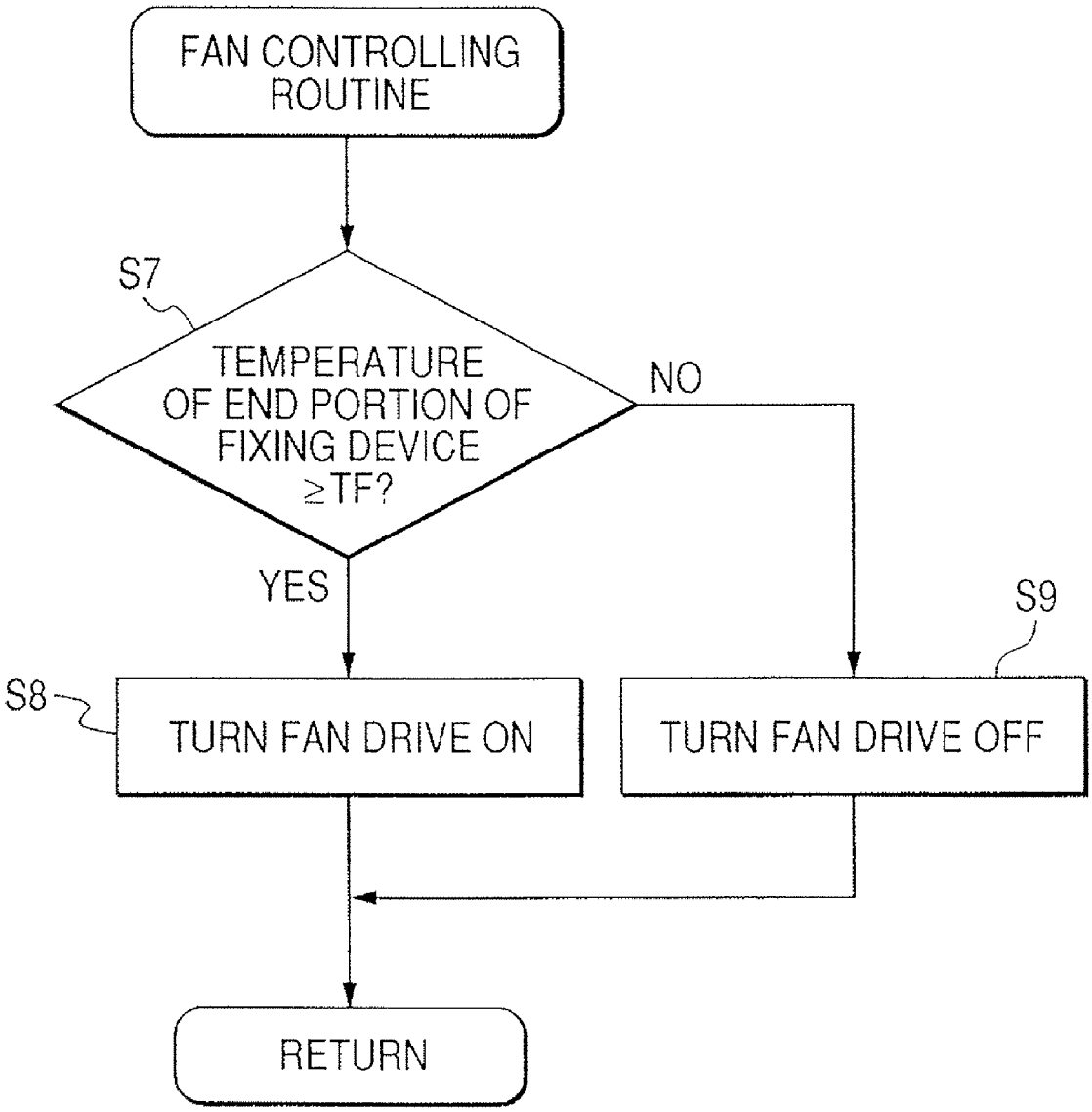
FIG. 14 is a flowchart showing a temperature control of a fixing fan.

With reference to the flowcharts shown in FIGS. 13 and 14, the temperature distribution in a case where the air blowing/cooling mechanism portion 20B is driven is a temperature distribution indicated by the broken line L2 of FIG. 12.

The fans 41 are controlled by temperature TF detected by the second temperature sensor TH2 which serves as the first control signal, a controlled temperature thereof is set as T5, and the temperature is controlled to be T5±5 degree. In other words, the detected temperature TF is evaluated in FIG. 14 (S7), the cooling fans 41 are turned on at T5+5 degree (S8), and the cooling fans 41 are turned off at T5−5 degree (S9).

Figure 15:
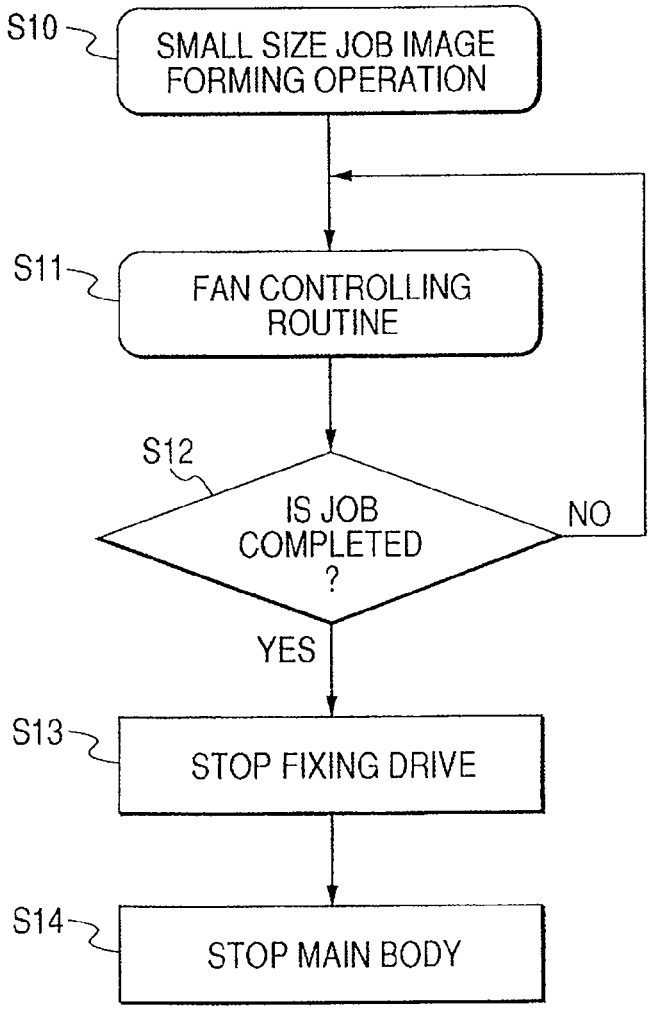
PRIOR ART FIG. 15
FIG. 15 is a flowchart showing a control timing of a cooling fan according to a conventional art.

A control flow at the time of ending the image formation according to a conventional art is shown in FIG. 15. To be specific, a recording material passes the fixing apparatus to be delivered, and then in response to a job completion signal (S12), a fixing drive is stopped (S13), and after a lapse of a predetermined time, a main body drive is stopped (S14).

Figure 16:
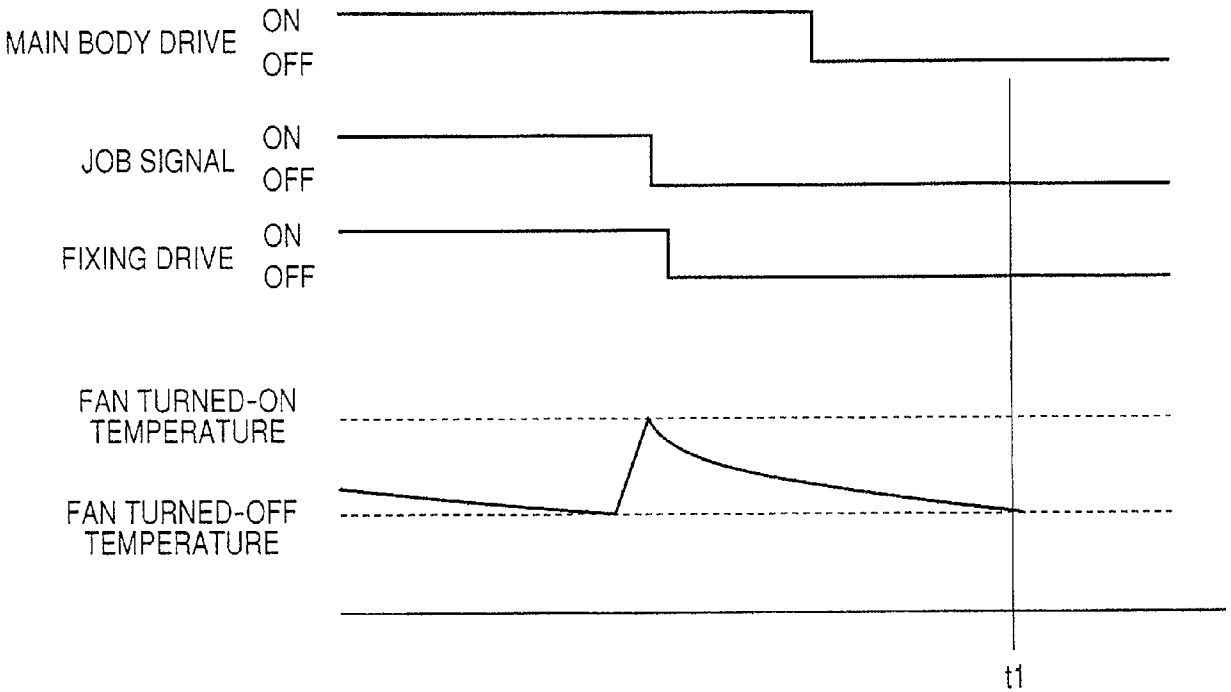
PRIOR ART FIG. 16
FIG. 16 is a sequence diagram showing a stop timing of the cooling fan according to the conventional art.

However, in this case, the following problem is caused. That is, in a case where the fan is turned on at the stop of the fixing drive as shown in FIG. 16, and the temperature detected by the second temperature sensor TH2 is not lowered to a fan turned-off temperature, the fan is continuously driven. In this case, at a time point (i.e., time t1 of FIG. 16) where the temperature of the non-sheet passing portion "a" becomes T5−5 degree, the cooling fan is stopped, thereby forming a region B (see FIG. 12), in which the temperature is low, at a border portion between the sheet passing area W2 and the non-sheet passing portion "a". The temperature distribution at this time is indicated by the dotted line L3 of FIG. 12.

This is because both of the fixing member and the pressure member are high in temperature when the temperature of the non-sheet passing portion is raised, so a cooling rate becomes relatively slow. Meanwhile, the low temperature region B in the vicinity of the sheet passing portion is not only deprived of heat by a recording material, but also is cooled by the fan, so the temperature of the pressure roller is also lower than the end portion, and a decrease in temperature is advanced compared with that of the sheet passing area.

Immediately after that, when the recording material having a paper width of W1 is passed, the first temperature sensor TH1 of the central portion rapidly reaches the predetermined controlled temperature through heating of the heater 35. However, the end portion is high in temperature, so the temperature of the end portion is lowered by waiting for a start of the sheet passing or by driving the fan, thereby starting the sheet passing at a timing when the temperature of the end portion and the temperature of the central portion are the same. However, the temperature lowered portion B, which is generated by rotating the fan after being stopped, is less likely to be uniform in temperature, thereby generating uneven glossiness due to uneven temperature at a position corresponding to the temperature lowered portion.

As a result, in this embodiment, with regard to the control of the fan, as shown in FIG. 13, in addition to a turned-off operation (i.e., first turned-off mode) by the temperature detected by the second temperature sensor TH2 which serves as the first control signal in a fan controlling routine (S2), a turned-off operation (i.e., second turned-off mode) by a second control signal is provided. To be specific, a fan drive turned-off signal (S4) by the job completion signal (S3) is provided. In other words, the operation of the air blowing/cooling mechanism portion (i.e., cooling means) 20B is controlled by the first control signal obtained based on the temperature detected by the second temperature detecting means TH2 and the second control signal obtained based on the information other than the temperature.

In this embodiment, irrespective of the temperature detected by the second temperature sensor TH2, the fan is controlled to be turned off also by the job completion signal.

As described above, in this embodiment, the cooling operation is completed by turning off the fan. However, it is preferable that the shutter is moved from an opened position to a closed position (i.e., a position where an air duct opening is closed) in accordance with the end of the job. This is because the fan is arranged near the non-sheet passing portion of the fixing member, so the fan, which is low in heat resistance, is exposed to a high-temperature atmosphere through the air duct due to the temperature rise of the non-sheet passing portion. As a result, it is possible to suppress heat deterioration of the fan and enhance durability of the cooling mechanism.

Thus, it is impossible for the fan to continuously rotate even after the stop of the fixing drive or after the drive of the image forming apparatus main body is completed. This eliminates generation of uneven glossiness at a time of subsequent image formation due to the temperature lowered area B generated at a border between the sheet passing portion and the non-sheet passing portion. Also, it is possible to suppress unnecessary energy consumption due to the drive of the fans 41 at an unnecessary timing.

Further, the second control signal is a completion notifying signal of image formation (i.e., job) in the above description. However, the second control signal may be a drive completion signal of the rotary driving device of the film 33 serving as the image heating member. In this case, the fixing drive is stopped also in a case where processing of interrupting sheet passing processing during the job such as a calibration operation of the image forming apparatus main body, or a toner replenishing operation is performed. That is, the cooling operation is stopped in accordance with the stop of the rotation of the film 33. Alternatively, the cooling operation is stopped in response to the completion signal of image heating processing. As a result, a life span of the fixing apparatus is prolonged, and the uneven glossiness due to the uneven cooling by the air blowing/cooling mechanism portion 20B at the time of stop can be prevented.

In the above description, the operation of the air blowing/cooling mechanism portion 20B by the second temperature detecting sensor TH2 is the turned-on or turned-off operation of the fans 41. However, the fans 41 are constantly rotated, so the same effect is obtained in the opening/closing operation of the air blowing ports 43 by the shutter driving device 45.

Alternatively, the operation of the air blowing/cooling mechanism portion 20B based on the job completion signal serving as the second control signal may be the closing operation of the air blowing ports 43 by the shutters 44.

In the above description, the fixing member is cooled by the fans 41, but the same effect is obtained by adopting a structure of cooling the pressure member.

In the above description, the image heating member is a thin belt-type fixing member with low heat capacity. However, the image heating member is not particularly limited thereto, and the same effect is obtained by using a roller-type fixing member.

The image heating apparatus is not limited to the above-mentioned film heating type heating apparatus, but a heat-roller-type heating apparatus or other heating apparatuses may be used. An electromagnetic induction heating type apparatus may also be used.

In the above description, a recording material is allowed to enter with the center of the fixing apparatus in the width direction as a reference, that is, a so-called central sheet passing reference is adopted. However, the same effect can also be obtained in, for example, a structure in which a recording material is allowed to enter with the end portion of the fixing apparatus in the width direction as a reference, that is, a so-called one-side sheet passing reference is adopted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-265872, filed Sep. 13, 2005 which is hereby incorporated by reference herein in its entirety.

What is claimed is:

1. An image heating apparatus, comprising:

an image heating member, which heats an image on a recording material in a nip portion;

temperature detecting means for detecting temperature of a predetermined region of the image heating member;

cooling means for cooling the predetermined region of the image heating member, the cooling means being provided with air blowing means for blowing air toward an air blowing port to cool the predetermined region of the image heating member, and a shutter which opens and closes the air blowing port;

a first controlling portion configured to control the cooling means to perform a cooling operation for cooling the predetermined region of the image heating member when the detected temperature reaches a first predetermined temperature, and to control the cooling means to stop the cooling operation when the detected temperature reaches a second predetermined temperature lower than the first predetermined temperature; and a second controlling portion configured to stop the cooling operation for cooling the predetermined region of the image heating member in accordance with an end of image heating processing in spite of the detected temperature being higher than the second predetermined temperature so that the temperature of a border portion between the predetermined region of the image heating member and a sheet passing area of the recording material is not lower than the temperature of the predetermined region and to move the shutter to a closed position in accordance with the end of the image heating process.

2. The image heating apparatus according to claim 1, wherein the cooling operation is stopped in response to a rotation stop signal of the image heating member.

3. The image heating apparatus according to claim 1, wherein the cooling operation is stopped in response to an end signal of the image heating processing.

4. The image heating apparatus according to claim 1, wherein the air blowing operation is stopped in accordance with the end of the image heating processing irrespective of the detected temperature of the image heating member and the shutter is moved to the closed position when the air blowing operation is stopped.

5. The image heating apparatus according to claim 1, wherein stopping of the cooling operation corresponds to a closing operation of the shutter.

* * * * *